US007285741B2

(12) United States Patent
Kato

(10) Patent No.: US 7,285,741 B2
(45) Date of Patent: Oct. 23, 2007

(54) PUSH-BUTTON SWITCH

(75) Inventor: Nobuo Kato, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 149 days.

(21) Appl. No.: 11/303,947

(22) Filed: Dec. 19, 2005

(65) Prior Publication Data

US 2006/0137966 A1 Jun. 29, 2006

(30) Foreign Application Priority Data

Dec. 28, 2004 (JP) ..... 2004-378939

(51) Int. Cl.
*H01H 13/52* (2006.01)

(52) U.S. Cl. ..... 200/513; 200/341; 200/5 A

(58) Field of Classification Search ..... 200/510–517, 200/314, 341–345, 5 A; 400/472, 489, 490
See application file for complete search history.

(56) References Cited

U.S. PATENT DOCUMENTS 4,430,531 A * 2/1984 Wright ..... 200/5 A
4,582,967 A * 4/1986 Brumit et al. ..... 200/5 A
4,952,761 A 8/1990 Viebrantz
5,569,889 A * 10/1996 Bruner ..... 200/5 A
5,783,787 A 7/1998 Data
6,774,330 B2 * 8/2004 Blossfeld et al. ..... 200/512
6,940,030 B2 * 9/2005 Takeda et al. ..... 200/343

FOREIGN PATENT DOCUMENTS

| | | |
|---|---|---|
| DE | 38 09 770 A1 | 10/1989 |
| EP | 0 841 672 A2 | 5/1998 |
| FR | 2 554 630 | 5/1985 |
| GB | 2 122 029 | 1/1984 |
| JP | Y2 63-43715 | 11/1988 |

* cited by examiner

*Primary Examiner*—Elvin Enad
*Assistant Examiner*—M. Fishman
(74) *Attorney, Agent, or Firm*—Oliff & Berridge, PLC

(57) ABSTRACT

It is intended to provide a push-button switch capable of providing a comfortable and natural click touch. To achieve the purpose, the button turns downward about the point which joins the buckling wall to the base on the back face side. Accordingly, the pulling force on the buckling wall does not occur when the button is pressed. Consequently, a user needs less pressing force, and can feel a clear and quite natural click touch.

8 Claims, 7 Drawing Sheets

PUSH-BUTTON SWITCH

TECHNICAL FIELD

The disclosure relates to a push-button switch which is used for a mobile electronic equipment such as an electrical dictionary and a tape printer, and a keyboard.

BACKGROUND

Conventionally, a push-button switch has a key top which is pressed by fingers to be operated, and supported by an elastic support body such as a spring. The key top is pressed down against a supporting force of the elastic support body, so that a movable contact integrally formed with the key top comes into contact with a fixed contact, so that an electrical circuit is energized conductive.

Recently, a mobile electronic equipment is provided with many switch mechanisms for input of operations. As shown in FIG. 7A, the switch mechanism includes the push-button switch in which a button 101 made of an elastic material such as a silicon rubber is integrally provided with a buckling wall 103 in its lower part, and is elastically supported by the buckling wall 103.

In this case, the button 101 protrudes outward through a through-hole 8 made in a cover body 109, providing a predetermined clearance between the through-hole 108 and the periphery of the button 101. When the button 101 is pressed down from directly overhead, the button 101 moves along its axis, and a movable contact 116 comes in contact with fixed contacts 105, 106 securely (see FIG. 7B). However, when a user presses an edge, or a cover, of the button 101, the button 101 moves inclining as shown in FIG. 7C, and the movable contact 116 touches only a part of the fixed contacts 105, 106. This results in a state of poor contact. When the button 101 is pressed inclining, the outer edge of the button 101 comes into contact with an inner circumference of the through-hole 8 in the cover body 9, thereby interfering smooth returning of the button 101.

To cope with the above problems, Japanese examined utility model publication No. S63(1988)-43715 discloses a push-button switch arranged as follows: a turning support part of which a bottom end is always in contact with a board, or an upper end is with the bottom end of the button, is provided on the underside of the button in order to prevent one of four faces of a returning elastic body formed along a perimeter of a button from becoming deformed by the operating force on the button. When operated, the button is inclined with its one side supported on the turning support body.

However, the push-button switch of the '715 publication has several problems because the push-button switch is inclined with its one side supported as stated above. Specifically, when a user presses the top face of the button at the side opposite to the turning support part, a pulling force of the button on the returning elastic body is generated on the turning support part side. Because of the force, the user would need to press the button with the stronger force, and feel worse click touch. The returning elastic body would be broken with continuous pressing the button.

SUMMARY

The disclosure has been made in view of the above circumstances and has an object to overcome the above problems and to provide a push-button switch capable of providing a comfortable and natural click touch.

To achieve the purpose above, there is provided a base, a buckling wall extending from the base, a button connected to the buckling wall, and provided with a front face, a back face, a left side face, and a right side face, a board on which the base is placed, a cover body provided with a through-hole through which the button protrudes, while keeping a clearance with respect to the front face of the button, a rib formed as a protrusion on the bottom face of the button near the back face, the rib being separated from the board when the button is unpressed, and brought into contact with the board and preventing a buckling deformation of the buckling wall on the back face side when the button is pressed, a movable contact formed as a protrusion on the bottom face of the button, nearer the front face side than the rib, to face fixed contacts provided on the board, the movable contact being apart from the fixed contacts when the button is unpressed, and allowing a buckling deformation of the buckling wall on the front face side when the button is pressed, and a supporting point which is a point joining the base and the buckling wall of the button on the back face side, wherein the button turns around the point when the button is pressed.

In the above push-button switch, the button turns downward about the point which joins the buckling wall to the base on the back face side. Accordingly, the pulling force on the buckling wall does not occur when the button is pressed. Consequently, a user needs less pressing force than when the rib is in contact with the board from the beginning, and can feel a clear and quite natural click touch.

Furthermore, the buckling wall on the back face side does not receive the load by the deformation of the buckling wall on the back side when the button is pressed. Accordingly, the buckling wall is never broken because of the load by the deformation.

DETAILED DESCRIPTION

Figure 1:
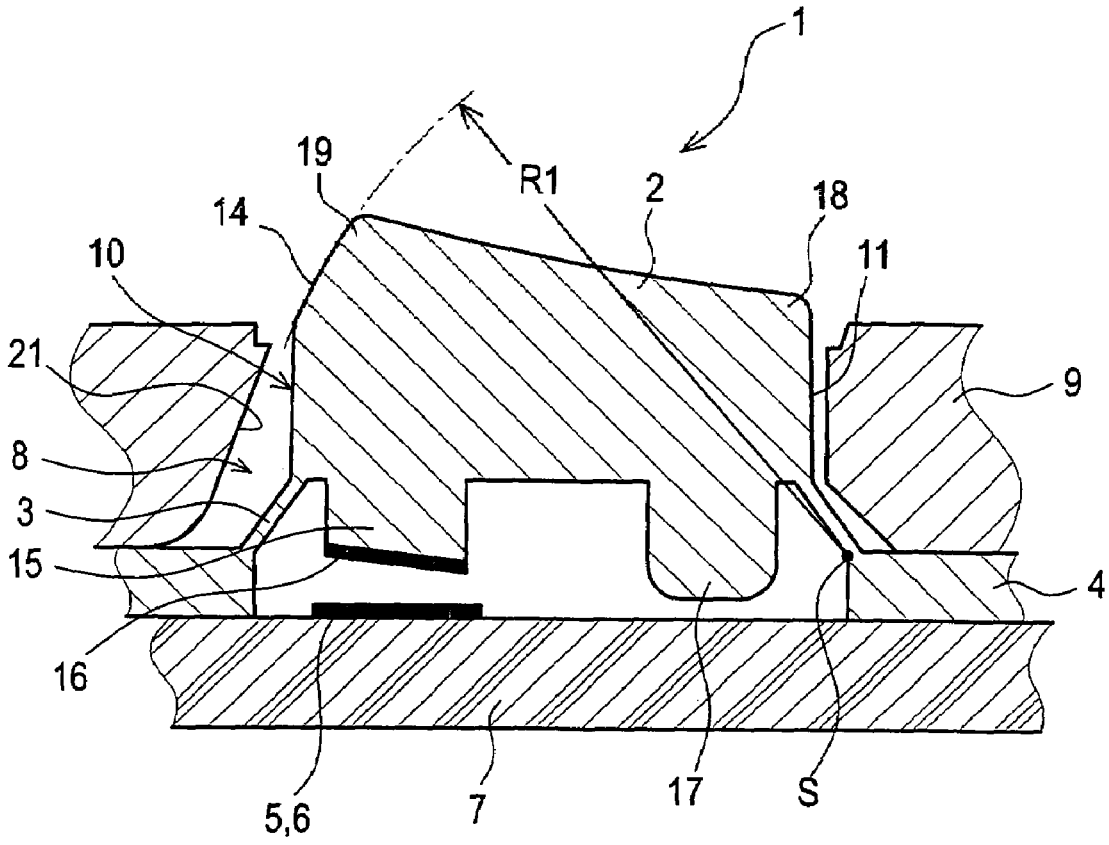
FIG. 1 is a sectional view of a push-button switch in a first exemplary embodiment, showing an unpressed state thereof.
Figure 2:
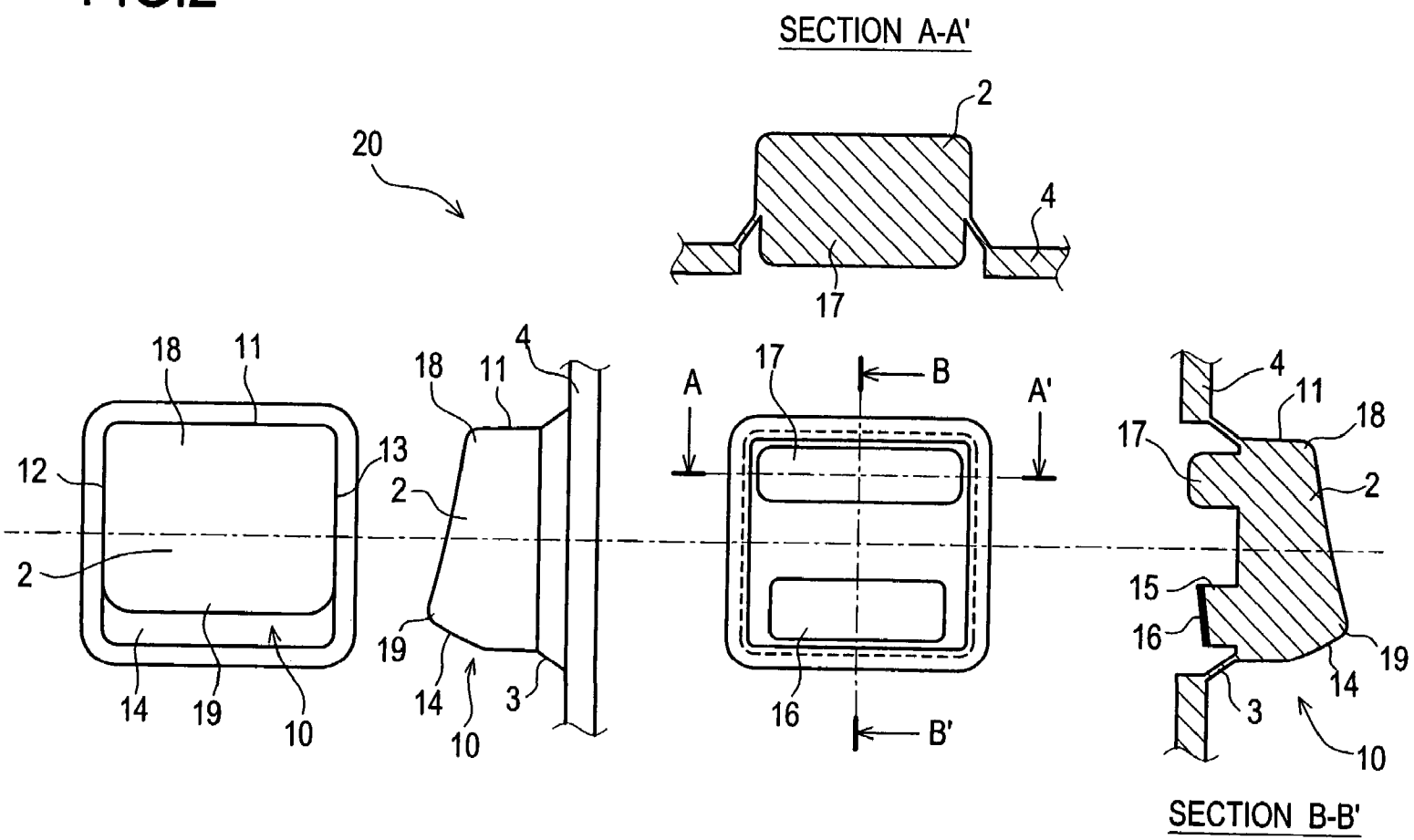
FIG. 2 shows an operating member of the push-button switch.
Figure 3A:
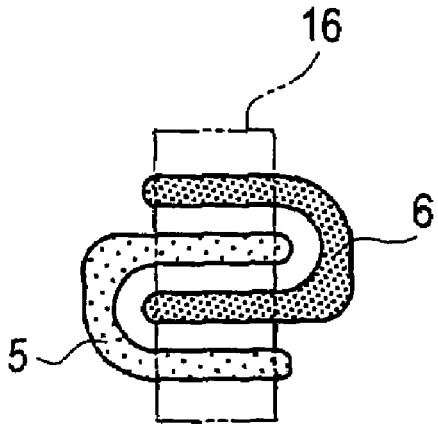
FIG. 3A shows one-unit sized fixed contacts.
Figure 3B:
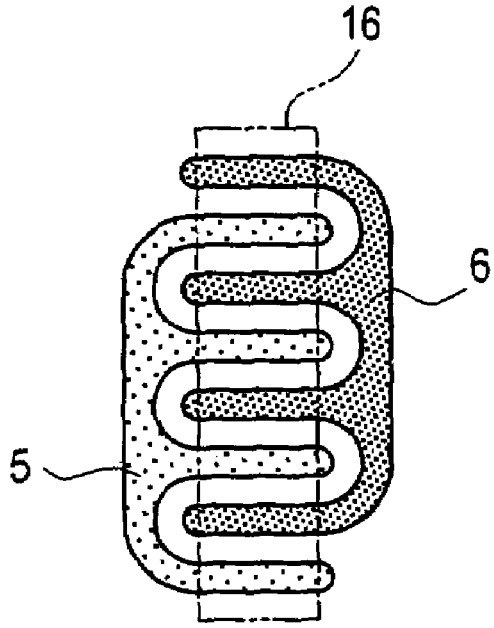
FIG. 3B shows long-sized fixed contacts.
Figure 4A:
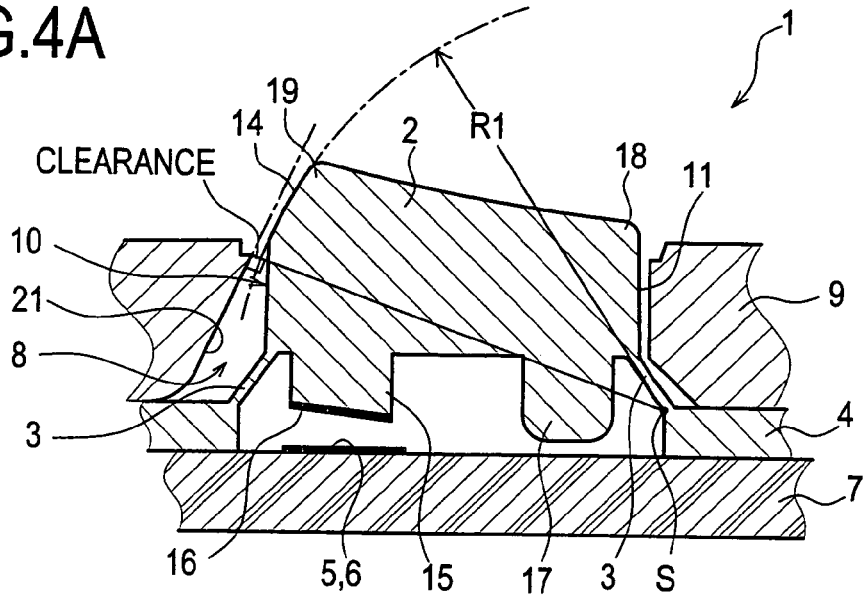
FIG. 4A is an explanatory drawing to show an operation of the push-button switch when the button is not pressed.
Figure 4B:
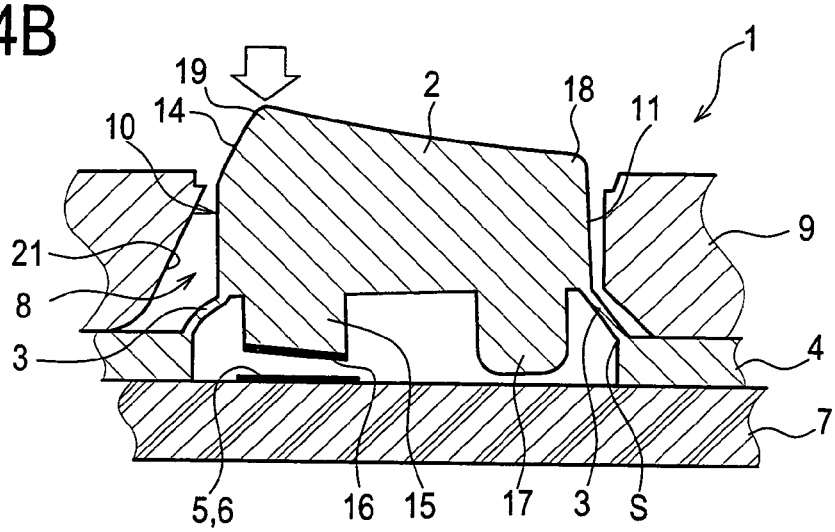
FIG. 4B is an explanatory drawing to show the operation of the push-button switch while the button is being pressed.
Figure 4C:
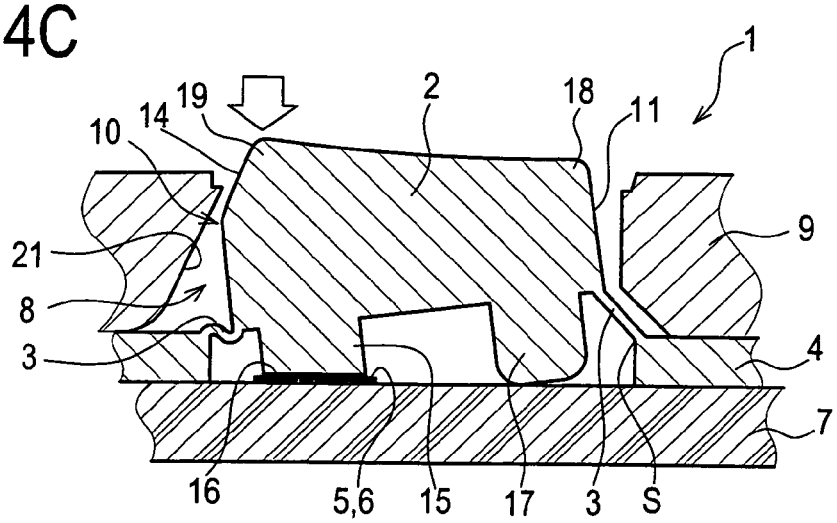
FIG. 4C is an explanatory drawing to show the operation of the push-button switch when a movable contact is in contact with the fixed contacts on a board.
Figure 5:
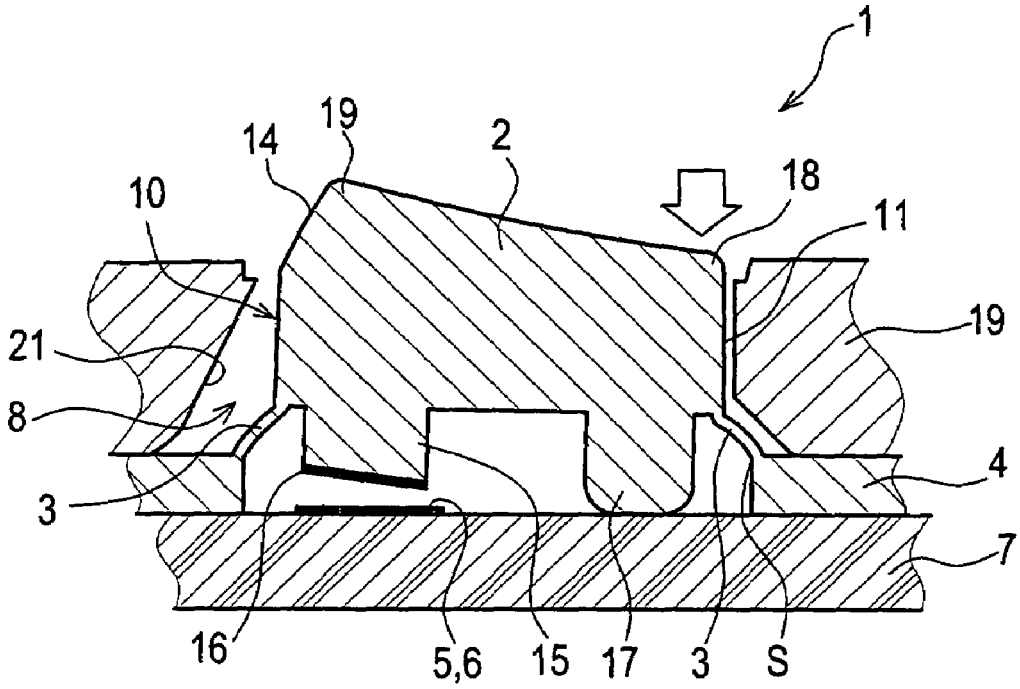
FIG. 5 shows the push-button switch when a thin part of the button is pressed.

A detailed description of a first exemplary embodiment of a push-button switch will now be given referring to the accompanying drawings. Firstly, a schematic structure of the push-button switch in the first exemplary embodiment will be explained with reference to FIGS. 1 to 5. FIG. 1 is a sectional view of a push-button switch in the first exemplary embodiment when a button is not pressed. FIG. 2 shows an operating member of the push-button switch. FIG. 3A shows one-unit sized fixed contacts. FIG. 3B shows long-sized fixed contacts. FIG. 4A is an explanatory drawing to show an operation of the push-button switch when the button is not pressed. FIG. 4B is an explanatory drawing to show the operation of the push-button switch while the button is being pressed. FIG. 4C is an explanatory drawing to show the operation of the push-button switch when a movable contact is in contact with the fixed contacts on a board. FIG. 5 shows the push-button switch when a thin part of the button is pressed.

As shown in FIGS. 1 and 2, a push-button switch 1 is mainly provided with a button 2, a thin buckling wall 3, a base 4, a board 7, and a cover body 9. The buckling wall 3 is integrally molded with the button 2 so as to extend downward and outward around a bottom end of the button 2. The base 4 is formed by integrally molding with the bottom end of the buckling wall 3. The board 7 on which the base 4 is placed is formed with fixed contacts 5, 6 and a circuit pattern. The cover body 9 fixes the board 7, keeps a predetermined clearance around the periphery of the button 2, and has a through-hole 8 through which the button 2 protrudes upward.

The push-button switch 1, except the board 7 and the cover body 9, is made of synthetic rubber such as silicone rubber and EPDM (ethylene-propylene rubber). On a top face (an outside face) of the button 2, characters and symbols including numbers and alphabets are applied by printing, engraving, and other methods. The button 2 is formed like a rectangular projection having a front face 10, a back face 11, a left side face 12, and a right side face 13. An arc face 14 is extended from the upper end to the middle of the front face 10 in the downward direction. The arc face 14 is formed as arc having a radius R1 centered on a point S which joins the buckling wall 3 on the back face 11 side to the base 4. The arc face 14 may be formed from the upper end to the bottom end of the front face 10 of the button 2.

A protrusion 15 protruding downward is formed on a bottom face of the button 2 near the front face 10. The front face side of the protrusion 15 protrudes less than the back face side thereof. On the end of the protrusion 15, a rectangular movable contact 16 for performing an on-off operation is provided facing to the fixed contacts 5, 6 on the board 7. The height (length) of the protrusion 15 is enough to cause a buckling deformation of the buckling wall 3 on the front face 10 side when the movable contact 16 comes into contact with the fixed contacts 5, 6.

Furthermore, a rib 17 is formed on the bottom face of the button 2 near the back face 11. The rib 17 is formed in a long-sideways rectangular shape extending from under about the left side face 12 to under about the right side face 13. The height (length) of the rib 17 is enough to prevent the buckling deformation of the buckling wall 3 on the back face 11 side when the rib 17 comes into contact with the board 7.

The button 2 has a thin part 18 on the back face 11 side and a thick part 19 which is thicker than the thin part 18 on the front face 10 side. Usually, a user presses the thick part 19. The rectangular rib 17 improves the rigidity of the thin part 18.

The buckling wall 3, integrally molded like a thin wall between the button 2 and the base 4, is formed with an inclination and a thickness appropriate for providing an ideal click touch. The base 4 is also integrally molded with the bottom end of the buckling wall 3, and works as a basement to produce the ideal click touch. When a plurality of continuous push-button switches 1 is provided, the base 4 for each push-button switch 1 is molded in one piece. The button 2, the buckling wall 3 and the base 4 compose a functional member 20 of the push-button switch 1 (see FIG. 2).

The board 7 has the fixed contacts 5, 6 and the circuit pattern thereon which are formed of a copper foil adhered to a base such as paper phenol, paper epoxy, and glass epoxy and processed by means of etching, or printing and baking with conductive ink. As mentioned above, on the board 7, the fixed contacts 5, 6 and the circuit pattern are formed corresponding to the position of the movable contact 16. When the button 2 is pressed, the movable contact 16 comes into contact with the fixed contacts 5, 6 which are then electrically connected with each other through the movable contact 16, so that a signal from the fixed contact 5 is transmitted to the fixed contact 6, for instance. When providing a plurality of the continuous push-button switches 1, a multiple of pairs of the fixed contacts 5, 6 are formed on the single board 7. Shapes of the fixed contacts 5, 6 are shown in FIGS. 3A and 3B. FIG. 3A shows one-unit sized fixed contacts 5, 6. FIG. 3B shows long-sized fixed contacts 5, 6. Each of the fixed contacts 5, 6 is formed like teeth of a comb. The fixed contacts 5, 6 are arranged in non-contact with each other and with each tooth of the one contact placed between the teeth of the other contact. Further, the teeth of the fixed contacts 5, 6 are arranged at right angles to the longitudinal direction of the rectangular movable contact 16. As a result, the movable contact 16 will be surely brought into contact with the fixed contacts 5, 6.

The cover body 9 is provided with the through-hole 8 having a wall face 21, as mentioned above. The button 2 projects from the through-hole 8, keeping a predetermined clearance between the front face 10, back face 11, left side face 12, right side face 13, and the wall face 21. When a plurality of continuous push-button switches 1 is provided, the multiple through-holes 8 are formed in the single cover body 9.

The push-button switch 1 constructed as above is assembled with all members set upside down. Firstly, the cover body 9 is placed top down. On the cover body 9, the functional member 20 is set with the button 2 being penetrated through the through-hole 8 of the cover body 9. On the cover body 9 and the functional member 20, the board 7 is placed while the fixed contacts 5, 6 of the board 7 are being positioned in alignment with the movable contact 16 of the button 2. Finally, the board 7 is secured to the cover body 9, interposing therebetween the functional member 20, by a screw (not shown) which is tightened from the back face of the board 7 into a boss (not shown) extending from the cover body 9, so that the push-button switch 1 is finished. Another method to secure the board 7 is to push and elastically lock the board 7 onto the hook of the boss (not shown) extending from the cover body 9. The push-button switch 1 assembled as just described is used for an input device of a mobile electrical equipment such as an electrical dictionary and a tape printer, and a keyboard.

Operation of the push-button switch 1 assembled as stated above will be explained with reference to FIGS. 4A, 4B and 4C. FIG. 4A shows the push-button switch in a non-pressed state. In this state, the buckling wall 3 has not buckled yet, and the movable contact 16 and the rib 17 are in non-contact with the board 7.

FIG. 4B shows the button 2 in a pressed state. The user presses the button 2 with his finger mainly on the thick part 19 which is the highest point in the button 2. Therefore, the button 2 turns downward about the point S which joins the buckling wall 3 to the base 4 on the back face 11 side, based on the pressed point, the rigidity of the button 2, and the balance between the buckling walls 3 on the left side face 12 and right side face 13 (see FIG. 2) and that on the back face 11 side. In FIG. 4B, the buckling wall 3 on the front face 10 side of the button 2 has started to be compressed and deformed by the button 2 being pressed. Meanwhile, the buckling deformation of the buckling wall 3 on the back face 11 side does not appear. During the operation, both of the movable contact 16 and the rib 17 are still apart from the board 7.

As pressed more deeply, the button 2 turns further downward about the point S which joins the buckling wall 3 to the base 4 on the back face 11 side. The buckling wall 3 on the front face 10 side buckles and is deformed to provide the click touch while the buckling wall 3 on the back face 11 side does not buckles or is deformed, and then the movable contact 16 comes into contact with the fixed contacts 5, 6 on the board 7. This state is illustrated in FIG. 4C. At this time, for example, the fixed contacts 5, 6 are electrically connected with each other through the movable contact 16, and the signal from the fixed contact 5 is transmitted to the fixed contact 6. At the same time, the movable contact 16 and the rib 17 come into contact with the board 7 together, which produce a characteristic to press down the button 2 more smoothly, and a better click touch. In these operations, if the rib 17 gets in contact with the board 7 before the movable contact 16 touches the fixed contacts 5, 6 because of the side-to-side inclination of the button 2, the rib 17 can correct the inclination by coming in contact with the board 7. Further, when the button 2 is pressed in case the rib 17 is already in contact with the board 7, the pulling force is generated on the buckling wall 3 on the rib 17 side, causing a heavy pressing force and a less click touch. However, the movable contact 16 and the rib 17 simultaneously come into contact with the fixed contacts 5, 6 and the board 7 respectively, which can prevent the generation of the pulling force on the buckling wall 3 on the rib 17 side even when the button 2 is pressed.

The arc face 14 is provided on the front face 10 of the button 2. The arc face 14 is formed having the radius R1 (see FIG. 4A) centered on a point S which joins the buckling wall 3 to the base 4 on the back face 11 side, extending from the upper end to the middle of the front face 10 in the downward direction. There is a clearance (see FIG. 4A) between the arc face 14 of the button 2 and the wall face 21 of the cover body 9, so that the arc face 14 does not touch the wall face 21 of the cover body 9 when the button 2 turns about the point S. Therefore, the clearance to be kept between the arc face 14 of the button 2 and the wall face 21 of the cover body 9 can be minimized.

FIG. 5 shows the button 2 of the push-button switch 1 when the thin part 18 of the button 2 is pressed. When the thin part 18 of the button 2 is pressed, the rib 17 comes into contact with the board 7 without causing buckling or deforming of the buckling wall 3 on the back face 11 side of the button 2. This prevents the button 2 from inclining or sticking. Besides, buckling deformation or transformation by elongation does not occur in the buckling wall 3 on the back face 11 side of the button 2, so that the buckling wall 3 receives no load of the deformation. The user will normally press the thick part 19 in which the user can obtain better click touch.

As explained in detail above, in the push-button switch 1 of the first exemplary embodiment, the protrusion 15 protruding downward is formed on the bottom face of the button 2 near the front face 10, and the movable contact 16 facing the fixed contacts 5, 6 on the board 7 is provided at a tip of the protrusion 15. In addition, the rib 17 protruding downward is formed near the back face 11 of the button 2. The rib 17 is separated from the board 7 while the button 2 is not pressed. When the button 2 is pressed, the rib 17 prevents the buckling deformation of the buckling wall 3 on the back face 11 side. The protrusion 15 is also apart from the fixed contacts 5, 6 while the button 2 is not pressed. When the button 2 is pressed, the movable contact 16 comes into contact with the fixed contacts 5, 6, and the buckling deformation of the buckling wall 3 on the front face 10 side occurs.

Accordingly, the button 2 turns downward about the point S which joins the buckling wall 3 to the base 4 on the back face 11 side, and the pulling force on the buckling wall 3 does not occur, and the user needs less pressing force. As a result, the user can feel a quite natural click touch when pressing the button 2.

Furthermore, the buckling wall 3 on the back face 11 side does not receive the load by the deformation of the buckling wall 3 on the back face 11 side, because the buckling deformation of the buckling wall 3 on the back face 11 side is avoided when the button is pressed, and the pulling force on the buckling wall 3 does not occur.

When the button 2 is pressed, the movable contact 16 comes into contact with the fixed contacts 5, 6 at the same time when the rib 17 comes into contact with the board 7. Even if the button 2 is further pressed after they are in contact, the buckling wall 3 is no more deformed, and will keep the shape when the rib 17 comes into contact with the board 7. Therefore, the fluctuation of the button 2 can be avoided.

The rib 17 is formed in a rectangular shape extending from under about the left side face 12 to under about the right side face 13. Accordingly, even if the pressed position on the button 2 is shifted to right or left by mistake, the rib 17 being in contact with the board 7 can correct the inclination of the button 2, and prevent the left side face 12 and the right side face 13 of the button 2 from bumping against the wall face 21 of the through-hole 8. The button 2 can be prevented from sticking to the cover body 9. The rigidity of the thin part 18 on the back face 11 side of the button 2 can be enhanced.

The arc face 14 is formed as an arc having a radius R1 (see FIG. 4A) centered about a point S which joins the buckling wall 3 to the base 4 on the back face 11 side, and extending from the upper end to the middle of the front face 10 of the button 2. The button 2 is pressed and turns downward about the point S, so that the front face of the button 2 does not touch the wall face 21 of the through-hole 8, and the user can obtain a comfortable and natural click touch when pressing the button 2. The button 2 can be also prevented from sticking to the cover body 9, since the front face 10 of the button 2 is in non-contact with the wall face 21 of the though-hole 8 in the cover body 9. Further, the clearance between the button 2 and the cover body 9 can be less, so that the exposure of the inside of the cover body 9 can be reduced. This offers flexibility in designing.

Figure 6A:
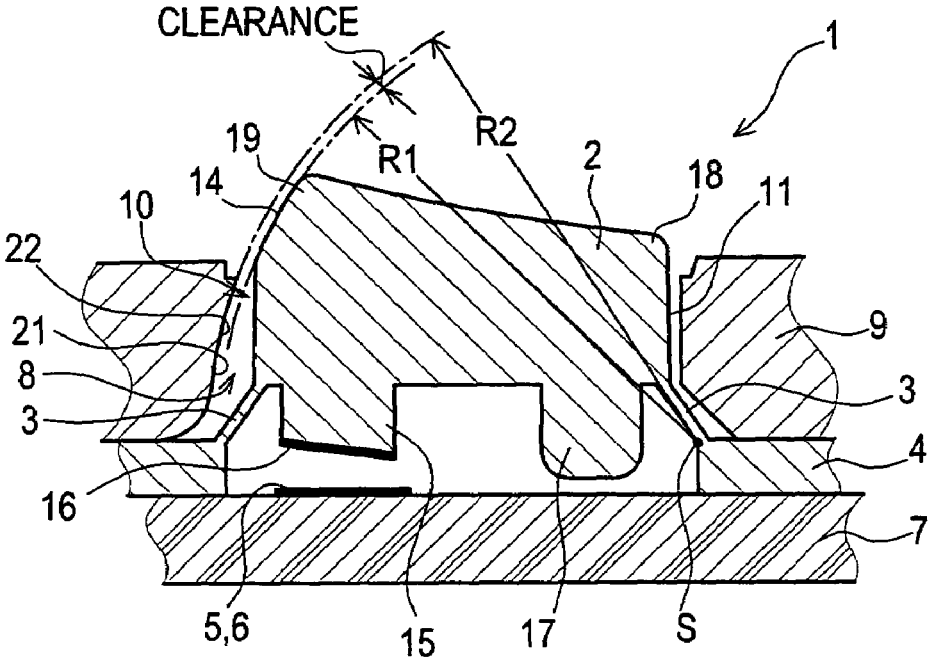
FIG. 6A is a sectional view of the push-button switch in a second exemplary embodiment showing the unpressed state thereof.
Figure 6B:
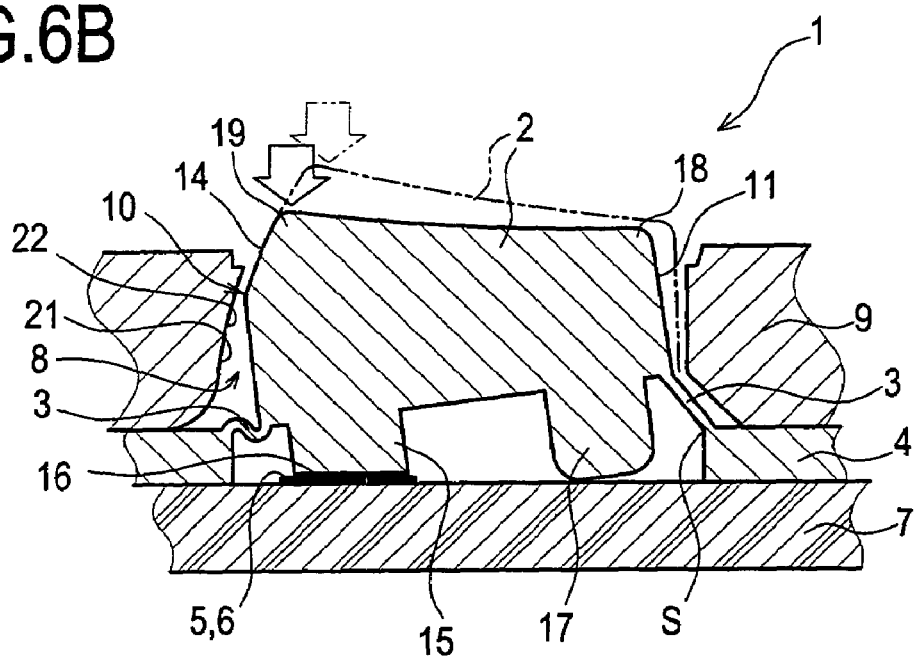
FIG. 6B is a sectional view of the push-button switch in the second exemplary embodiment, showing a state where the movable contact of the button is in contact with the fixed contact on the board.
Figure 7A:
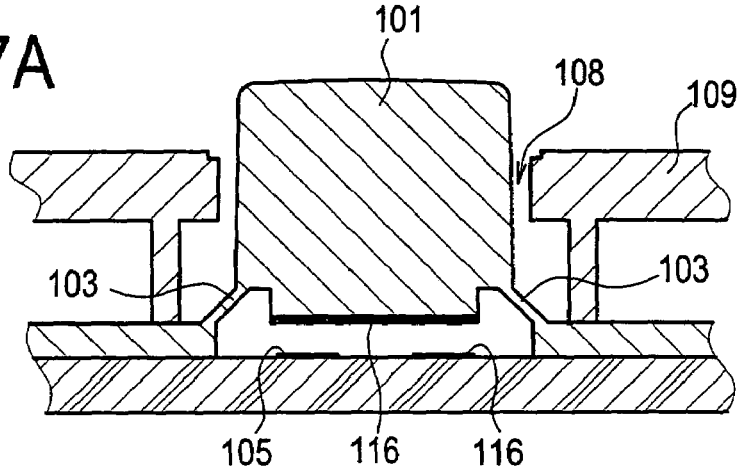
FIG. 7A is a sectional view of the conventional push-button switch when the button is not pressed.
Figure 7B:
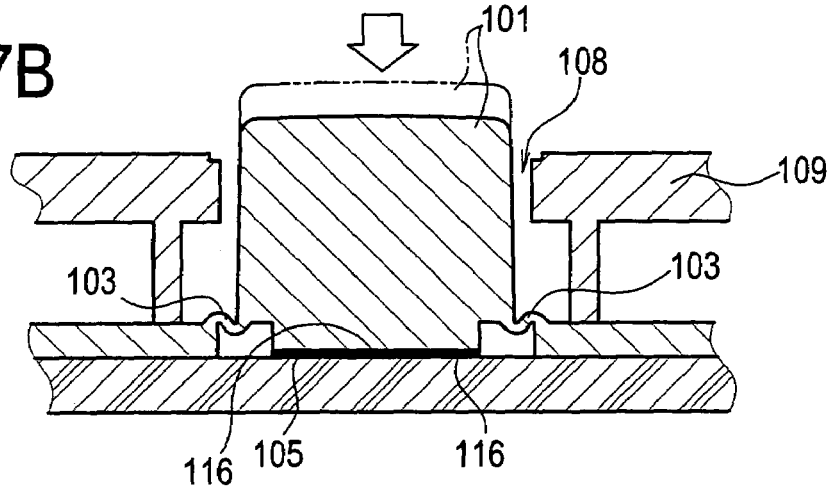
FIG. 7B is a sectional view of the conventional push-button switch when a center of a top face of the button is pressed.
Figure 7C:
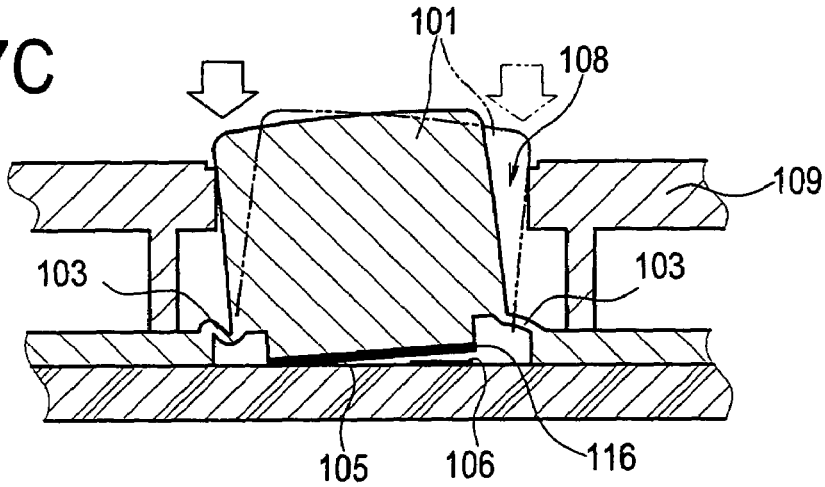
FIG. 7C is a sectional view of the conventional push-button switch when an edge of the top face of the button is pressed.

Next, a second exemplary embodiment will be explained with reference to the drawings. The push-button switch of the second exemplary embodiment is almost same as the push-button switch 1 of the first exemplary embodiment, but the configuration of the cover body 9 is partly different. FIG. 6A is a sectional view of the push-button switch in the second exemplary embodiment when the button is not pressed. FIG. 6B is a sectional view of the push-button switch in the second exemplary embodiment when the movable contact of the button is in contact with the fixed contact on the board. As mentioned above, the second exemplary embodiment is almost same as the first exemplary embodiment. Parts which are functionally the same as those in the first exemplary embodiment are assigned the identical reference numerals to those in the first exemplary embodiment in order to omit another explanation and only main point will be explained.

As shown in FIGS. 6A and 6B, the main point is in an arc face 22 of a radius R2 in a wall face 21 of the through-hole 8 in the cover body 9 which faces the front face 10 of the button 2. The arc face 22 is centered on a point S which joins the buckling wall 3 to the base 4 of the button 2 on the back face 11 side. The difference between the radii (R2-R1) corresponds to a clearance between the wall face 21 of the through-hole 8 and the front face 10 of the button 2. As shown in FIG. 6B, even if the arc face 14 of the button 2 turns downward about the point S which joins the buckling wall 3 to the base 4 of the button 2 on the back face 11 side, the same clearance are kept with the arc face 22 provided in the wall face 21 of the through-hole 8 in the cover body 9, and the arc face 14 is never in contact with the arc face 22.

As explained above, in the push-button switch 1 of the second exemplary embodiment, the wall face 21 forming the through-hole 8 in the cover body 9 which faces the front face 10 of the button 2 is formed along the arc face 22 of the radius R2 centered on a point S which joins the buckling wall 3 to the base 4 of the button 2 on the back face 11 side. The fixed clearance is thus always kept between the arc face 22 in the wall face 21 of the through-hole 8 in the cover body 9 and the arc face 14 in the front face 10 of the button 2, and both faces are never in contact with each other. Accordingly, the user can feel a quite natural click touch. Furthermore, the clearance in the through-hole 8 between the button 2 and the cover body 9 can be equal at all times, so that the inside of the cover body 9 can be invisible to the user, and flexibility in designing can be offered.

The invention is not limited to the first and second exemplary embodiments alone, but may be changed and modified in various manners within the scope of the invention.

For instance, the first and second exemplary embodiments use the board 7 made of a copper foil adhered to a base such as paper phenol, paper epoxy, glass epoxy, and others and processed by means of etching, printing with conductive ink, and baking. Instead of the board 7, a supporting board made of metal for instance may be used with a membrane switch made of polyester film set on the supporting plate, which effects reducing the thickness.

To enhance the rigidity of the button 2, synthetic rubber of different hardness may be formed by insert molding on the top face of the button 2. A resin such as an ABS may also be bonded to the top face of the button 2.

A member of identical shape with the rib 17 in the button 2 may be provided on the board 7. The board 7 may be replaced with a combination of membrane switches made of a metallic board, a polyester film and the likes so that a rib may be made on a metallic supporting board processed by a die (pressed).

While the presently exemplary embodiment has been shown and described, it is to be understood that this disclosure is for the purpose of illustration and that various changes and modifications may be made without departing from the scope of the invention as set forth in the appended claims.

What is claimed is:

1. A push-button switch comprising:

a base;

a buckling wall extending from the base;

a button connected to the buckling wall, and provided with a front face, a back face, a left side face, and a right side face;

a board on which the base is placed;

a cover body provided with a through-hole through which the button protrudes, while keeping a clearance with respect to the front face of the button;

a rib formed as a protrusion on the bottom face of the button near the back face, the rib being separated from the board when the button is unpressed, and brought into contact with the board and preventing a buckling deformation of the buckling wall on the back face side when the button is pressed;

a movable contact formed as a protrusion on the bottom face of the button, nearer the front face side than the rib, to face fixed contacts provided on the board, the movable contact being apart from the fixed contacts when the button is unpressed, and allowing a buckling deformation of the buckling wall on the front face side when the button is pressed; and a supporting point which is a point joining the base and the buckling wall of the button on the back face side, wherein the button turns around the point when the button is pressed.

2. The push-button switch according to claim 1, wherein the rib comes into contact with the board at the same time the movable contact comes into contact with the fixed contacts, when the button is pressed.

3. The push-button switch according to claim 1, wherein the rib is formed in a rectangular shape extending from under about the left side face to under about the right side face.

4. The push-button switch according to claim 1, wherein the button includes a thin part formed on the back face side, a thick part which is thicker than the thin part and formed on the front face side, and the front face of the button formed as an arc face centered on the point which joins the base to the buckling wall on the back face of the button side, while keeping a predetermined clearance between a wall face of the through hole and the front face of the button when the button is pressed.

5. The push-button switch according to claim 4, wherein the wall face of the through hole and facing the front face of the button is formed as an arc face having a radius centered on the point which joins the base to the buckling wall of the button on the back face side.

6. The push-button switch according to claim 1, wherein the movable contact is provided in the thick part of the front face side of the button.

7. The push-button switch according to claim 1, wherein the movable contact is formed in a rectangular shape extending from under about the left side face to under about the right side face.

8. The push-button switch according to claim 1, wherein the fixed contacts are facing each other and shaped like comb-teeth, and each tooth of the one contact is arranged between the teeth of the other contact, and an intermeshed length of each tooth of the fixed contacts is longer than a width of the movable contact.

* * * * *